US006981824B2

(12) United States Patent
Zingerman

(10) Patent No.: US 6,981,824 B2
(45) Date of Patent: Jan. 3, 2006

(54) SLING-TRAVERSE DEVICE FOR MASSIVE OBJECT LIFTING SYSTEM

(75) Inventor: David Zingerman, 1714 N. Ivar Ave., Apt. #803, Los Angeles, CA (US) 90028

(73) Assignee: David Zingerman, Los Angeles, CA (US)

( * ) Notice: Subject to any disclaimer, the term of this patent is extended or adjusted under 35 U.S.C. 154(b) by 499 days.

(21) Appl. No.: 10/348,505

(22) Filed: Jan. 21, 2003

(65) Prior Publication Data

US 2004/0141813 A1 Jul. 22, 2004

(51) Int. Cl.
*E02D 5/00* (2006.01)
*E02D 35/00* (2006.01)

(52) U.S. Cl. ..... 405/230; 405/229; 52/122.1; 52/125.6

(58) Field of Classification Search ..... 405/229, 405/230, 231, 232; 52/125.1, 125.6, 126.7, 52/122.1; 254/15, 17, 29 R
See application file for complete search history.

(56) References Cited

U.S. PATENT DOCUMENTS 4,634,319 A * 1/1987 May ..... 405/230
4,671,724 A * 6/1987 Bolton ..... 52/125.6
4,695,203 A * 9/1987 Gregory ..... 405/230
4,854,782 A 8/1989 May
5,765,806 A * 6/1998 Sargent ..... 254/29 R
6,193,442 B1 * 2/2001 May ..... 405/232
6,347,487 B1 * 2/2002 Davis ..... 52/169.9
6,368,022 B1 * 4/2002 Zingerman ..... 405/230
6,503,024 B2 * 1/2003 Rupiper ..... 405/230
2001/0046415 A1 * 11/2001 Rupiper ..... 405/232

FOREIGN PATENT DOCUMENTS

JP 04070424 * 3/1992 ..... 52/125.1

* cited by examiner

*Primary Examiner*—Jong-Suk (James) Lee
(74) *Attorney, Agent, or Firm*—David Zingerman

(57) ABSTRACT

A sling-traverse device for lifting system for elevation of the massive objects (constructions) provides a possibility to lift the solid over size and over weight objects. An improved sling-traverse device for massive construction lifting system includes an arched form traverse, a traverse connector, comprising a traverse flange, a lower portion of which is by a traverse hinge coupled with the traverse, and a sling flange, an upper portion of which is intended for coupling with the lifting system, and the opposite sides of the traverse flange and the sling flange are rigidly connected to each other. The traverse includes two pairs of levers on each of side of the arch, and each two appropriate levers are coupled to each other by the stiffener and resting girder in their frontal lower part. Also the improved sling-traverse device includes a pushing spiral springs with a directional fingers respectively coupled with the appropriate brackets connected to the appropriate shackles and levers.

1 Claim, 6 Drawing Sheets

50-50

51-51

SLING-TRAVERSE DEVICE FOR MASSIVE OBJECT LIFTING SYSTEM

FIELD OF THE INVENTION

This invention relates to an apparatus intended to lift the massive objects (constructions) and mostly for lifting of the over size and over weight construction structures, particularly entire bridge sections and/or building structures such as solid roof assemblies and the like, which have to be lifted from their horizontal ground level initial position and to be horizontally leveled whereby the structural assembly has to be installed.

BACKGROUND OF THE INTENTION

The various types of the traverses for the lifting devices are well known. The lifting of the massive (over size) and heavy solid construction structures is a very difficult operation and requires a specific lifting apparatus, including a sling-traverse.

For example, the apparatus by U.S. Pat. No. 4,854,782 includes a pier, a sleeve mounted on the pier, a shoe connected to the base of a structure and mating with the sleeve, a lift bracket connected to the shoe and temporary lift means inserted between the sleeve and the lift bracket. The shoe is mated to the sleeve to allow substantially vertical movement of the shoe as the building is lifted. A hydraulic ram or jack inserted between the sleeve and the lift bracket serves as a temporary lifting means which, when extended, raises the structure to the desired position. Once in position, the building is permanently supported by securing the shoe to the sleeve. Thereafter, the ram and the lift bracket may be removed for use at a different site. A series of piers and lifting apparatus are usually required to support a single structure. The pier and the shoe are attached to the base of a structure. A sleeve, which acts as a means to guide the shoe and support the shoe on the pier, is placed on the pier and is adapted to mate with the shoe. In order to lift the structure, a lift bracket is attached to the shoe and a hydraulic ram or jack is inserted between the top of the sleeve and the bottom of the lift bracket. After the ram is extended to raise the structure to the desired level, pins are inserted through the shoe and shims inserted between the laterally extending plates of the sleeve and the pins driven through the shoe in order to permanently support the structure. After insertion of these permanent supports, the hydraulic ram and lift bracket may be removed and reused at a different site.

Such slinging shoe does not provide the safety and operates at the ground level not providing the lifting of the construction structure at the high levels.

Another apparatus by U.S. Pat. No. 4,634,319 includes a shoe which is attached to the structure to be lifted and which shoe received a pier driving assembly whereby a plurality of piers may be individually driven beneath the structure; there being a pier plate unit which is fitted over the top of each driven pier and then utilized to support lifting means which span the opening between the pier plate unit and the structure whereby the structure may be lifted to its ultimate desired position, there being permanent supporting means which are positioned between the pier plate unit and the structure for permanently retaining the structure in its desired position. This apparatus operates as following. The shoe is attached to the base of the structure and then the driving assembly is attached to the shoe whereby the assembly may be utilized to successively and individually drive piers beneath the structure. After the piers are driven a separate pier plate unit is fitted over the end of each of the piers, which piers have been cut off at ground level. Once in place, the pier plate unit is used to support lifting means which operate between the pier plate unit and the structure to lift the structure to the desired position. After the structure has reached this position permanent, adjustable supporting means are placed between the pier plate unit and the structure whereby to retain the structure in the desired position.

Such apparatus has the same deficiency described of the above (operates at the ground level and does not provide the structure lifting at the high levels), but is more lightweight then previous prior art.

Another system, providing the slinging of the massive, solid constructions by U.S. Pat. No. 6,368,022, comprises at least one of a plurality of lifting devices, each of which comprises at least one of a plurality of main hydraulic jacks, the major jacks, the auxiliary jacks, sling-traverse with a pivoting stand respectively coupled teach other by bearing, the supports for pivotable stand and the lifting sectional tape comprising the removable sections having the apertures for the fixing of the appropriate tape's section in its position by the locking fingers. Each lifting device also includes the upper and lower girders and the rests.

The sling-traverse is coupled with the base by the auxiliary hinge. The base is also coupled with the pivoting stand. At the pause positions of the lifting process, the pivoting stand is leaned on the rests. The pivoting stand is rotatable inside column through 90° clockwise or counter-clockwise, that is provided by the bearing coupling two holders: the lower holder and the upper holder. The lower holder is permanently connected to the pivoting stand and the upper holder is permanently connected to the base. At the lifting cycle, the lower holder is hanged on the upper holder via bearing. The bracket is permanently connected to the base and provides (by the fixing finger and the pivoting stand aperture) fixing of the pivoting stand at the one of three fixed positions: −90°, 0°, +90°.

Such sling-traverse requires the operator's (rigger's) activity on each step of the massive object lifting process (to rotate the pivoting stand from 0° position /the pivoting stand is leaned on the rests/ to 90° position /the lifting cycle—the pivoting stand is not leaned on the rests/), that decreases the degree of safety.

Thus, there is a great need in the art for the improved sling-traverse for lifting system intended for massive object (construction) elevation, eliminating the operator's (rigger's) activity under the lifting object.

OBJECT AND ADVANTAGES OF THE INVENTION

Accordingly, several objects and advantages of the present invention are to provide the safety lifting of the horizontally positioned solid, massive construction structures on the high level.

It is another object of the invention to provide the possibility for the horizontally positioned solid, massive construction structure lifting without necessity of the operator's activity during each lifting cycle of the lifting process.

It is still another object of the invention to eliminate auxiliary lifting devices or scaffold for operator/rigger to reach the sling-traverse at each high level (upper of the ground level) of the lifting process.

It is further object of the invention to increase the efficiency of the massive construction installation.

It is still further object of the invention to reduce the time of the massive construction installation.

Still, further objects and advantages will become apparent from a consideration of the ensuing description accompanying drawings.

DESCRIPTION OF THE DRAWING

In order that the invention and the manner in which it is to be performed may be more clearly understood, embodiments thereof will be described by way of example with reference to the attached drawings, of which.

SUMMARY OF THE INVENTION

A sling-traverse device for lifting system for elevation of the massive constructions provides a possibility to lift the solid over size and over weight objects. An improved sling-traverse device for massive construction lifting system includes a traverse, traverse connector, comprising a traverse flange, a lower portion of which is by a traverse hinge coupled with the traverse, and a sling flange, an upper portion of which is intended for coupling with the lifting system, and the opposite sides of the traverse flange and the sling flange are rigidly connected to each other. The arched form traverse includes two pairs of levers on each of side of the arch, and each two appropriate levers are coupled to each other by the stiffener and resting girder in their frontal lower part. Also the improved sling-traverse device includes a pushing spiral spring along the directional finger inserted inside the pushing spiral spring.

DESCRIPTION OF THE PREFERRED EMBODIMENTS

Here the description of an improved sling-traverse device will be done in statics (as if the components of the improved lifting system are suspended in the space) with description of their relative connections to each other. The description of the functional operations of an improved device will be done hereinafter.

Figure 1:
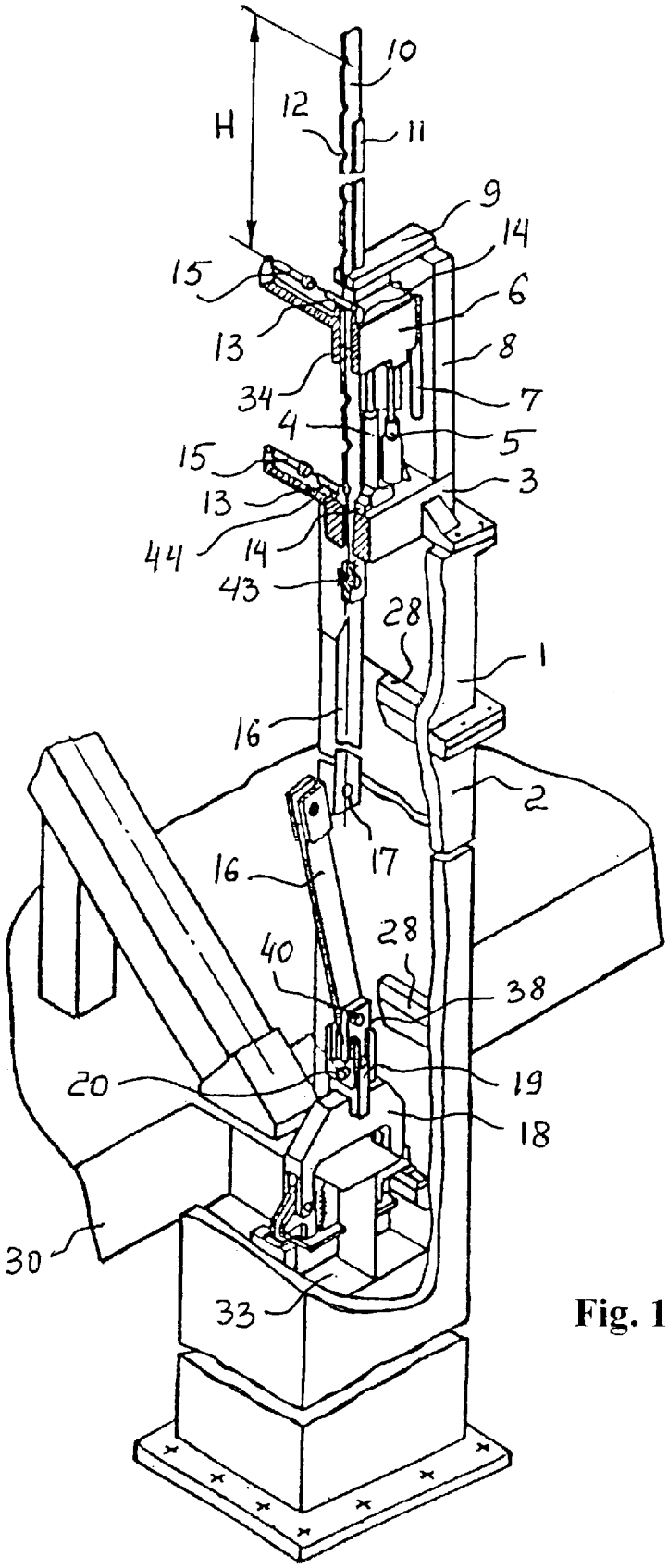
FIG. 1 is a simplified spatial view of an improved sling-traverse device assembly with a possible lifting device for lifting of the massive construction assembly.
Figure 5:
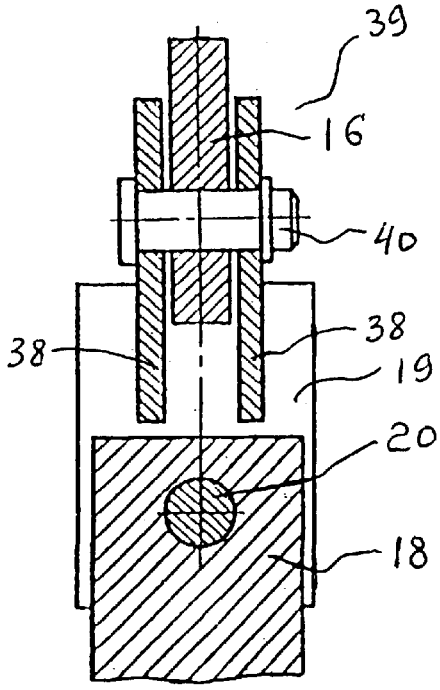
FIG. 5 is a simplified drawing of the cross-sectional view 50—50.
Figure 6:
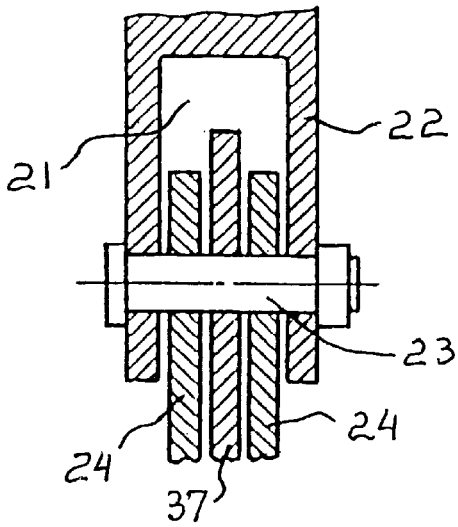
FIG. 6 is a simplified drawing of the cross-sectional view 51—51.

An improved sling-traverse device includes a traverse 18, traverse connector 39, comprising a sling flange 38 and a traverse flange 19. On FIGS. 1, 2, 5, the flanges 38 and 19 are presented by two parallel sling flanges 38 and two parallel traverse flanges 19 rigidly connected to each other. The pair of flanges 38 are perpendicular to the pair of flanges 19, as shown on FIGS. 1–3. Both sling flanges 38 includes the symmetrical apertures 17 (the axes of the apertures are coincident) for the sling hinge 40 passage, and both traverse flanges 19 includes the symmetrical apertures 17 (the axes of the apertures, are coincident) for the traverse hinge 20 passage, as shown on FIGS. 2, 5. The hinges 40 and 20 can be removable and the bolts, for example, can be used instead of the hinges 20 and 40. The sling flanges 38 are by hinge 40 coupled with the lifting tape 10, and the traverse flanges 19 are by hinge 20 coupled with the traverse 18. The traverse 18 has an arched configuration with two slots 21 symmetrically located along the longitudinal axis of the traverse 18 in its lower portion, formning the shackles 22 on the both sides of the arch respectively. Each slot 21 provides the passage of two levers 24 pivotable along their vertical plane. The lower sides of the levers 24 are rigidly connected to the resting girder 27 and the inner sides 25 of the levers 24 are rigidly connected to the stiffener 26 as shown on FIG. 3. The pair of levers 24 with the strengthening rib 37 inserted between them are installed in the shackle 22 and coupled with the shackle 22 by the finger-hinge 23, as shown on FIG. 6. The upper side of each levers 24 can have some kind of the semicircular configuration. The stopper 32 is rigidly connected to the H-girder-corbel 33 of the lifting object (massive construction) 30. The stopper 32 eliminates the possible friction of the levers 24 with the inner side of column 2 during lifting process. Each lever 24 is coupled with the appropriate pushing spiral spring 35 installed into two spring holders 46, which are rested on the spring upper bracket 48 rigidly connected to the appropriate shackle 22 and on the spring lower bracket 49 rigidly connected to the appropriate lever 24 respectively. The directional finger 36 is housed inside the pushing spiral spring 35, as shown on FIGS. 2–4, and connected by the upper side via spring hinge 45 to the appropriate spring upper bracket 48, and by the lower side via director 47 to the appropriate spring lower bracket 49.

The improved sling-traverse device (number 41 on FIG. 2) operates as follows. In the initial position, the lifting tape 10 of each of a plurality of lifting devices 29 (for example, each of four synchronously operating lifting devices 29, as shown on FIG. 7) is coupled (by the locking finger 13 inserted in the highest aperture 12 of the lifting tape 10) with the appropriate upper girder 6. The insertion of the locking finger 13 in the aperture 12 is provided by the auxiliary jack 15.

Figure 2:
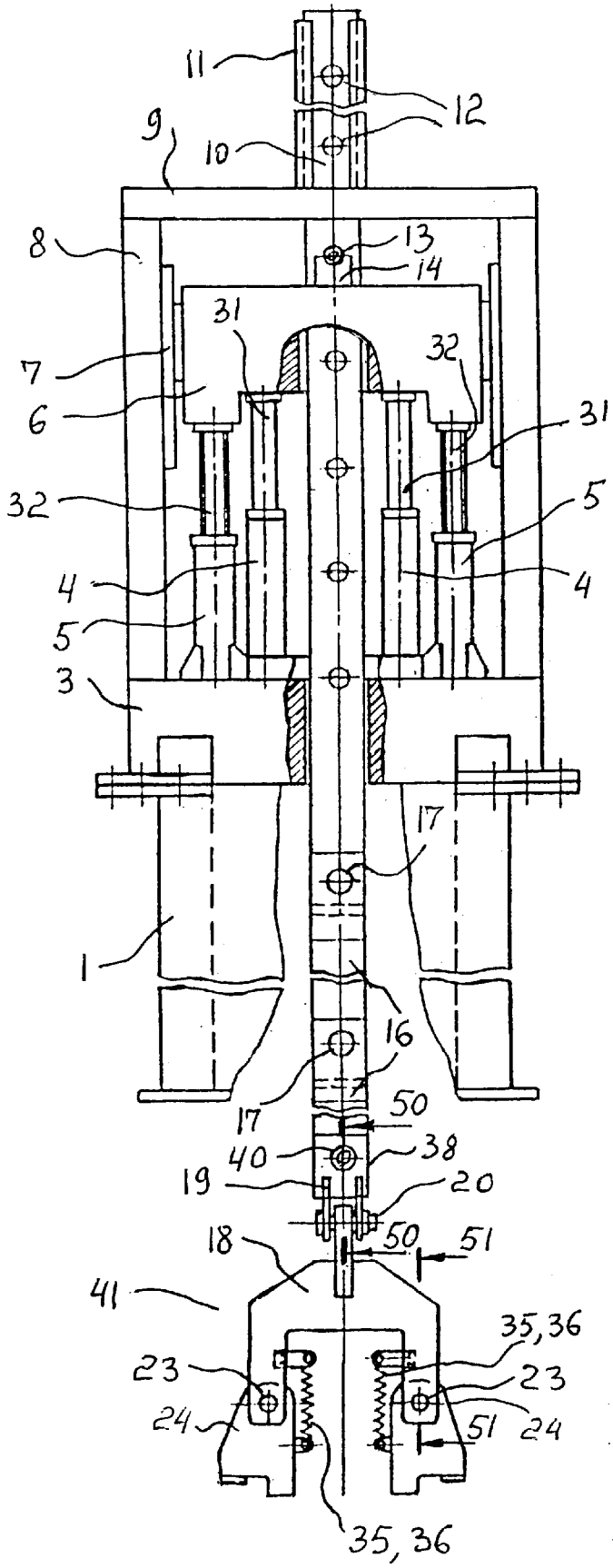
FIG. 2 is a simplified drawing of an improved sling-traverse device with a possible lifting device for lifting of the massive construction.

The H-girder-corbel 33 of the construction 30 is inserted into improved sling-traverse device of each lifting device 29 (see FIG. 2). For the lifting of the construction, the drives (not shown) of the main hydraulic jacks 4 are synchronously turned-on and the rams 31 are synchronously raised, thereby lifting the appropriate upper girders 6. When the first cycle of the lifting is completed (the rams 31 are in the final extended position), the treaded rams 42 of the major jack 5 uprise at their final extended (upper) position to insure the position of the ram 31 of the main hydraulic jacks 4 (the final extended position of the treaded rams 42 can be adequate to the final extended position of the rams 31, depending on the upper girder 6 form/configuration). At this stage, the lower locking finger 13 (by the lower auxiliary jack 15) is inserted in the appropriate lower aperture 12 of the lifting tape 10 (see FIG. 2). The upper locking finger 13 is pulled out of the highest aperture 12, the auxiliary jacks 15 are released (pulled down), the drives (not shown) of the main hydraulic jacks 4 are synchronously turned-off releasing the rams 31, thereby moving the upper girder 6 down. At this stage, the lifting tape 10 holds the construction 30. Then, the upper locking finger 13 is inserted in the next (lower) aperture 12 (the next aperture 12, that is lower the previous aperture 12), the lower locking finger 13 is pulled out of its aperture 12, and the lifting device is ready for the next lifting cycle.

Figure 7:
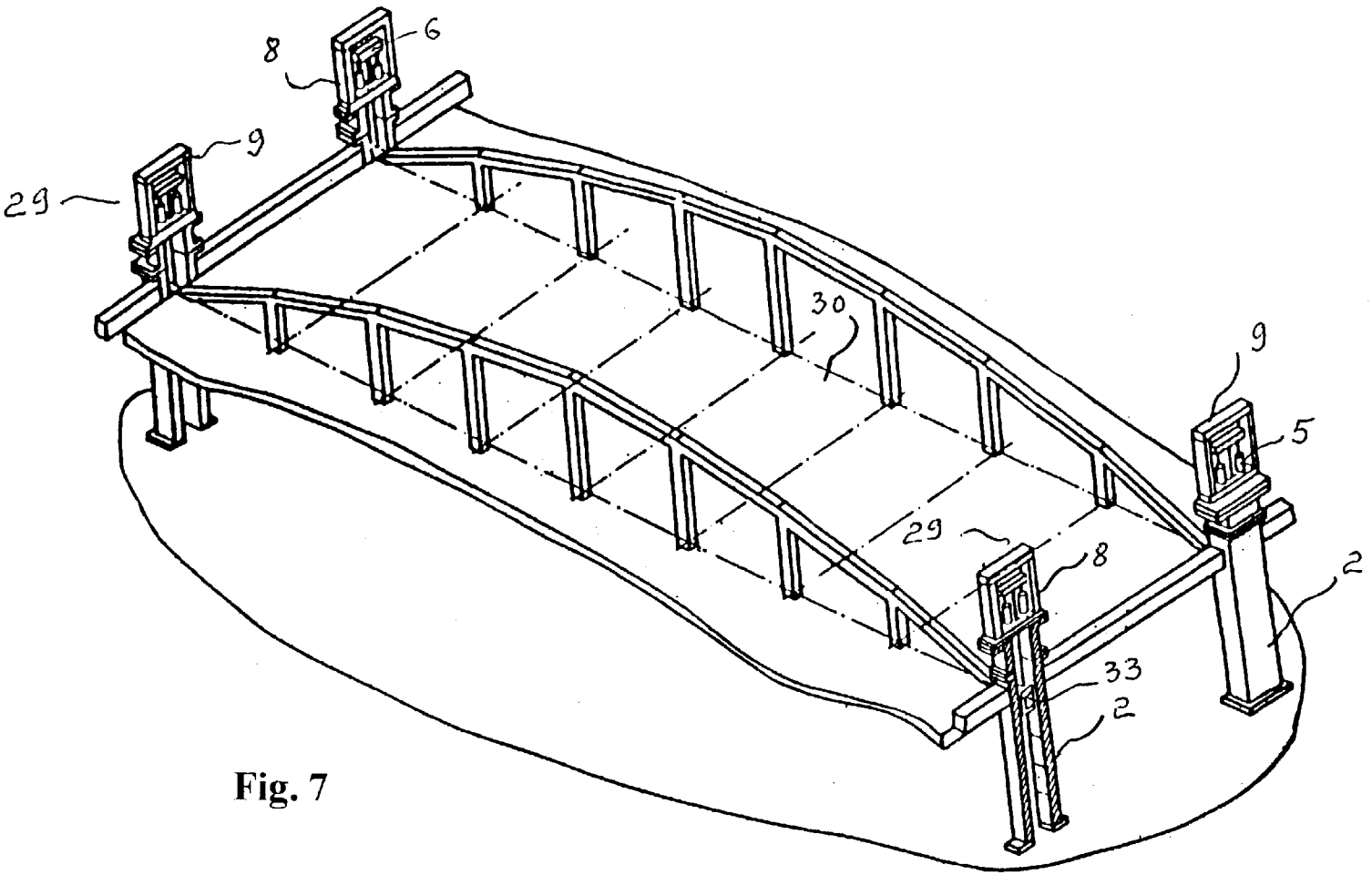
FIG. 7 is an illustration of the hypothetical lifting system able to use an improved sling-traverse.

Referring to FIG. 7, each lifting device 29 can include a support 1 rigidly connected to a column 2 of the constructing structure (for example, a column of the building such as a covered sport arena under construction, a pier of the bridge under construction or aircraft hangar, etc.). The columns 2 of the constructing building have a hollow configuration with the permanently built-in rests 28, as shown on FIGS. 1, 3 and 4. The lower girder 3 of the lifting device 29 is installed on the support 1. Also the lifting device 29 includes at least one of a plurality of main hydraulic jacks 4 (on FIG. 2 are shown, for example, two main hydraulic jacks 4). The main hydraulic jacks 4 and the major jacks 5 are connected to the lower girder 3. The upper girder 6 is installed on the rams 31 of the main hydraulic jacks 4. The upper girder 6 is fixed by the main directors 7 of the stanchions 8. The stanchions 8 provide the horizontal displacement prevention for the upper girder 6. The bottoms of the stanchions 8 are permanently connected to the lower girder 3 and their tops are connected by the lateral girder 9. The lifting (metallic) sectional tape 10 is passes trough the slits into the lower 3 and upper 6 girders, and through the slit (not shown) into the lateral girder 9. The top of the lifting sectional tape 10 (the part of the lifting tape 10, which is over the lateral girder 9) passes along the major director 11. The lifting sectional tape 10 has at least one of a plurality of removable sections 16. The sections 16 are connected to each other by the removable hinges 43, passing through the apertures 17, as shown on FIG. 1. The length of each section 16 is mostly the same and is calculated to provide reliability to carry the heavy construction. Each section 16 has the apertures 12 in order to fix the appropriate section of the lifting sectional tape 10. The fixing of the lifting tape 10 is provided by the locking fingers (pins) 13, moved by the auxiliary jacks 15 located horizontally. Each auxiliary jack 15 has the locking finger clipping device (not shown), providing the reciprocative movement of the locking finger 13, thereby inserting the locking finger 13 into the appropriate aperture 12. The locking finger 13 is moved along the semi-cylindrical slot 14 located into the lower 44 and upper 34 auxiliary girders. Each lifting device 29 includes two auxiliary girders: the upper auxiliary girder 34, which is permanently connected to the upper girder 6 and the lower auxiliary girder 44, which is connected to the lower girder 3, as shown on FIG. 1. At this stage, the lifting tape 10 is hanged on the locking finger 13 which is leaned on the upper girder 6. The distance between centers of the apertures 12 is the same and is adequate to the step of the main hydraulic jack 4 extension for one lifting cycle.

The main hydraulic jack 4 extension for one lifting cycle is also adequate to the lifting step of the lifting sectional tape 10 elevation for one lifting cycle. The quantity of the apertures 12 in one section 16 determines a quantity of the lifting cycles for this section and defines the length of the section. The quantity of the sections 16 depends on the assigned height of lifting. For example, a sport arena cover has to be lifted on 40 yard height, then if, for example, H=6 yards, the lifting device 29 includes 7 (seven) sections 16, each of which has 6 yards of distance "H" between centers of the hinges 17. The lower section 16 of the lifting tape 10 is coupled with the sling flange 38 by the sling hinge 40. The removable hinges 43 provide possibility of the sequential section 16 removal after all apertures 12 of this section are used.

The rests 28 are rigidly connected to the inner side of column 2, as it is mentioned above and shown on FIGS. 1, 4. The rests 28 are used to release the lifting tape 10 of a load. During each lifting cycles, the levers 24 are by resting girder 27 leaned on the rests 28.

So, each lifting cycle is started and completed, when the sling-traverse device with the inserted H-girder-corbel 33 is leaned on the pair of the rests 28. During each lifting cycle the main hydraulic jacks 4 raises the upper girder 6, which pulls the lifting tape 10 up, thereby lifting the loaded sling-traverse device.

Figure 3:
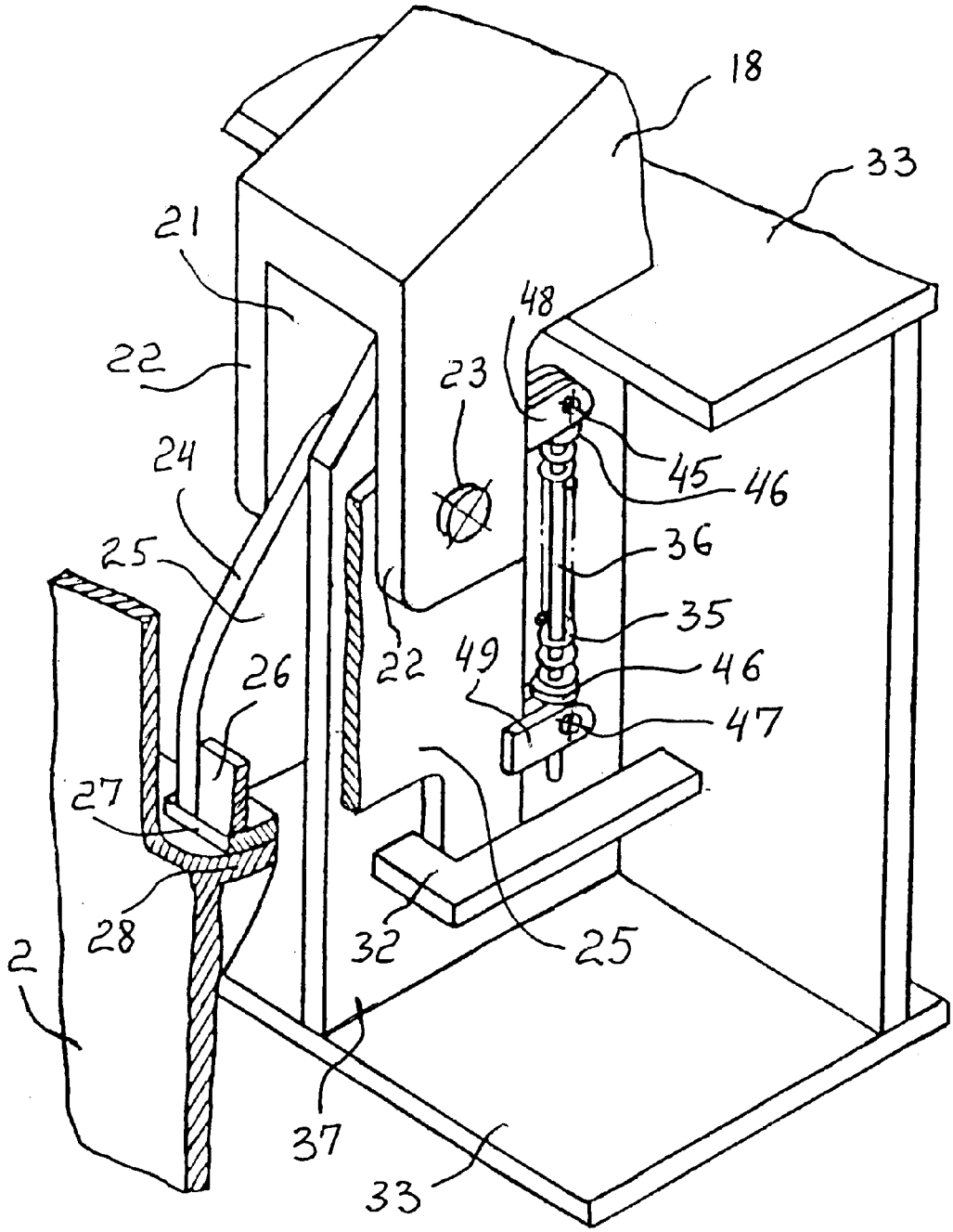
FIG. 3 is a simplified spatial view of the initial position of an improved sling-traverse device.
Figure 4:
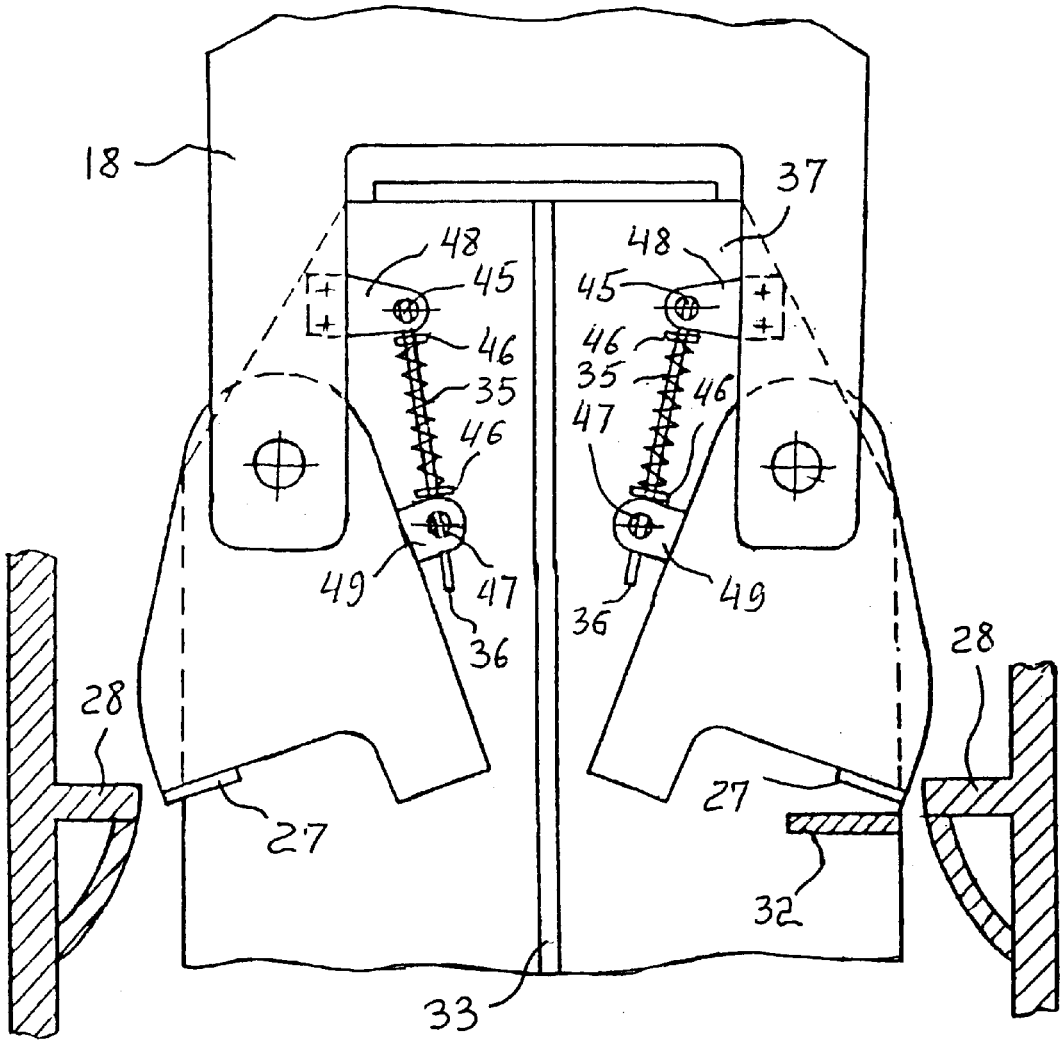
FIG. 4 is a simplified drawing of the intermediate position of an improved sling-traverse device.

The traverse 18 pulls the H-cirder-corbel 33 up by strengthening rib 37. At this stage, the resting girder 27 is got off the rests 28. On FIG. 3 is shown the position, when the resting girder 27 of the lever 24 is leaned on the rest 28. On FIG. 4 is shown the intermediate position of the lifting cycle, when the lever 24 passes the rest 28. At this time the pushing spiral spring is 35 are slightly pressed along directional finger 36, and after the rest 28 is passed the spring 35 returns the lever 24 to the regular position (the lever 24 reaches the stopper 32) to be ready to lean on the rests 28. The level of the bottom of the resting girder 27 at the end of each elevation cycle is a little over the level of the top of the rests 28.

After that, the valve(s) (not shown) of the main hydraulic jacks 4 are slow open, the upper girder 6 goes down pulling the lifting tape 10 down, thereby pulling down the loaded traverse 18, and the resting girder 27 is leaned on the rests 28.

Thus, an improved lifting system for massive constructions provides the lifting of the solid over weight and over size objects from their horizontal ground level initial position and to be horizontally leveled whereby the structural assembly has to be installed.

CONCLUSION, RANIFICATION AND SCOPE

Accordingly the reader will see that, according to the invention, I have provided a sling-traverse device for lifting system, providing massive solid constructions elevation. An improved sling-traverse device has various possibilities, considering activities of the lifting systems.

While the above description contains many specificities, these should be not construed as limitations on the scope of the invention, but as exemplification of the presently-preferred embodiments thereof. Many other ramifications are possible within the teaching to the invention. For example, an improved sling-traverse device for the massive solid construction lifting system, provides simplification of the technological cycles of construction work and eliminates the necessity of the rigger activity during the lifting process. Also an improved sling-traverse provides a higher degree of safety.

Thus, the scope of the invention should be determined by the appended claims and their legal equivalents, and not by examples given.

THE DRAWING REFERENCE NUMERALS WORKSHEET

1.—a support;
2.—a column;
3.—a lower girder;
4.—a main hydraulic jack,
5.—major jack;
6.—an upper girder;
7.—a main director;
8.—a stanchion;
9.—lateral girder;
10.—a lifting sectional tape;
11.—a major director;
12.—an aperture;
13.—a locking finger;

14.—a slot;
15.—an auxiliary jack;
16.—a removable section;
17.—an aperture;
18.—a traverse;
19.—a traverse flange;
20.—a traverse hinge;
21.—a slot;
22.—a shackle;
23.—a finger-hinge;
24.—a lever;
25.—an inner side of the lever 24;
26.—a stiffener;
27.—a resting girder
28.—a rest;
29.—a lifting device;
30.—a construction;
31.—a ram;
32.—a stopper;
33.—a H-girder-corbel;
34.—an upper auxiliary girder;
35.—a pushing spring
36.—a directional finger;
37.—a strengthening rib;
38.—an sling flange;
39.—a traverse connector;
40.—a sling hinge;
41.—a sling-traverse device;
42.—a threaded ram;
43.—a removable hinge;
44.—a lower auxiliary girder;
45.—a spring hinge;
46.—a spring holder;
47.—a director;
48.—a spring upper bracket;
49.—a spring lower bracket;
50.—cross-sectional view;
51.—cross-sectional view.

What is claimed is:

1. A sling-traverse device for massive object lifting system providing the elevation of a solid over size and over weight construction comprising an arch-shaped traverse including a shackle on each side of the arch, and wherein each said shackle comprises a slot along longitudinal axis of said traverse of said sling-traverse device;

two levers on each said side of said arch rigidly connected to each other in their front lower portion by a stiffener and by a resting girder, and wherein each of the levers includes a pushing spiral spring located on the back side of said each of the levers, and wherein said pushing spiral spring comprises a spring holder on each end of said pushing spiral spring;

a directional finger housed inside said pushing spiral spring and connected by an upper side to a spring hinge, which is connected to a spring upper bracket of the appropriate shackle, and by a lower side to a director, which is connected to a spring lower bracket of the appropriate lever;

a stopper, providing a limitation of the clockwise movement of said two levers and wherein said stopper is rigidly connected to a H-girder-corbel of said solid over size and over weight construction;

a strengthening rib housed between said two levers;

a finger-hinge appropriately coupling said two levers and said strengthening rib between said two levers with the appropriate shackle;

a traverse connector, comprising a traverse flange, a lower portion of which is by a traverse hinge coupled with said traverse, and a sling flange, an upper portion of which is intended for coupling with the lifting system, and wherein the opposite sides of said traverse flange and said sling flange are rigidly connected to each other.

* * * * *